US012415663B2

(12) United States Patent
Hayden

(10) Patent No.: US 12,415,663 B2
(45) Date of Patent: Sep. 16, 2025

(54) DRIP RING DEVICE

(71) Applicant: Arvuan Hayden, Biloxi, MS (US)

(72) Inventor: Arvuan Hayden, Biloxi, MS (US)

( * ) Notice: Subject to any disclaimer, the term of this patent is extended or adjusted under 35 U.S.C. 154(b) by 70 days.

(21) Appl. No.: 18/388,232

(22) Filed: Nov. 9, 2023

(65) Prior Publication Data

US 2025/0153908 A1 May 15, 2025

(51) Int. Cl.
*B65D 47/40* (2006.01)

(52) U.S. Cl.
CPC ..... *B65D 47/40* (2013.01)

(58) Field of Classification Search
CPC ..... B65D 47/40; B65D 23/665; B65D 23/06; B65D 81/3876; A47G 23/0216; A47G 19/145
See application file for complete search history.

(56) References Cited

U.S. PATENT DOCUMENTS 3,185,341 A * 5/1965 Barbour ..... B65D 25/48 220/718
4,238,045 A * 12/1980 D'Andria ..... A47G 19/2272 220/254.5
4,299,100 A 11/1981 Crisman
4,625,890 A 12/1986 Galer
4,726,487 A * 2/1988 Mitri ..... B65D 1/265 D7/511
5,176,278 A 1/1993 Quarberg
6,202,877 B1 * 3/2001 La Torre ..... A47G 19/2272 220/254.1
8,052,004 B2 * 11/2011 Cheng ..... B65D 45/32 220/323
D834,419 S 11/2018 Baird
10,188,231 B2 1/2019 Hung
11,363,897 B2 6/2022 Opheim
2005/0103803 A1 * 5/2005 Hung ..... B65D 47/06 222/109
2008/0164282 A1 * 7/2008 Szekely ..... B65D 47/40 222/111

FOREIGN PATENT DOCUMENTS

WO WO2021091865 5/2021

* cited by examiner

*Primary Examiner* — Kareen K Thomas

(57) ABSTRACT

A drip ring device for capturing liquid that drips from a beverage cup includes a beverage cup and a lid that is attached to the beverage cup such that the lid closes the beverage cup. An annular channel is positionable around the beverage cup. The annular channel is urgeable into a seated position having the annular channel being positioned beneath the lid when the lid is attached to the beverage cup. In this way the annular channel defines a drip space beneath the lid to capture liquid that drips from the lid.

4 Claims, 8 Drawing Sheets

DRIP RING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to drip devices and more particularly pertains to a new drip device for capturing liquid that drips from a beverage cup. The device includes an annular channel that is positionable around a beverage cup. The annular channel is positioned beneath a lid on the beverage cup such that the annular channel captures liquid that drips from the lid. In this way the liquid is inhibited from potentially staining a user's clothing.

(2) Description of Related Art Including Information Disclosed Under 37 CFR 1.97 and 1.98

The prior art relates to drip devices including a variety of beverage cup lids that each has a modular construction that includes a drip ring to inhibit liquid from dripping from the lid and a spill preventing beverage cup that has a pair of annular rings that are attachable around a beverage cup. In no instance does the prior art disclose a drip ring device that includes an annular channel which is positionable around a beverage cup such that the annular channel defines a drip space beneath a lid attached to the beverage cup.

BRIEF SUMMARY OF THE INVENTION

An embodiment of the disclosure meets the needs presented above by generally comprising a beverage cup and a lid that is attached to the beverage cup such that the lid closes the beverage cup. An annular channel is positionable around the beverage cup. The annular channel is urgeable into a seated position having the annular channel being positioned beneath the lid when the lid is attached to the beverage cup. In this way the annular channel defines a drip space beneath the lid to capture liquid that drips from the lid.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
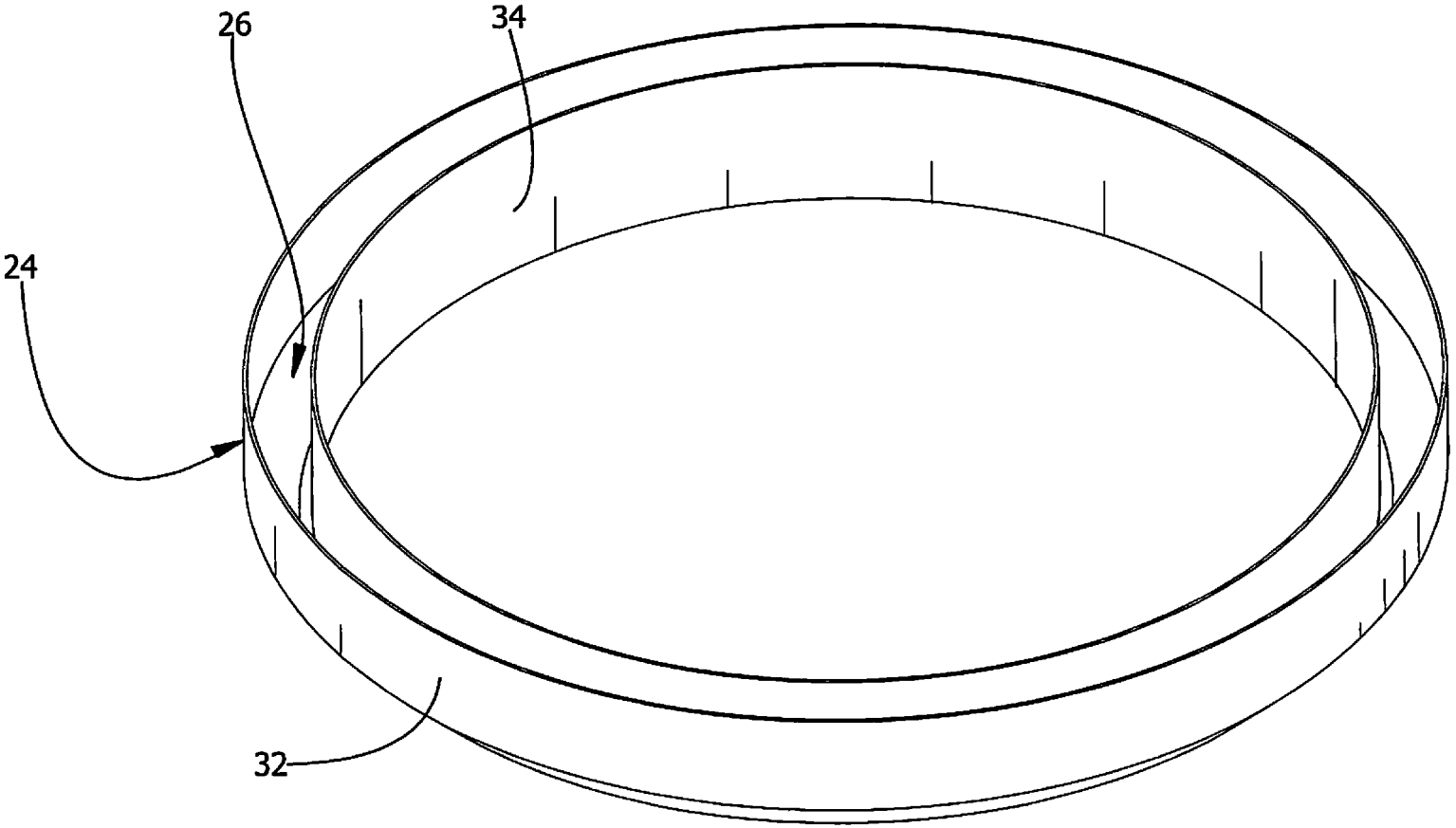
FIG. 1 is a top perspective view of an annular channel of an embodiment of the disclosure.
Figure 2:
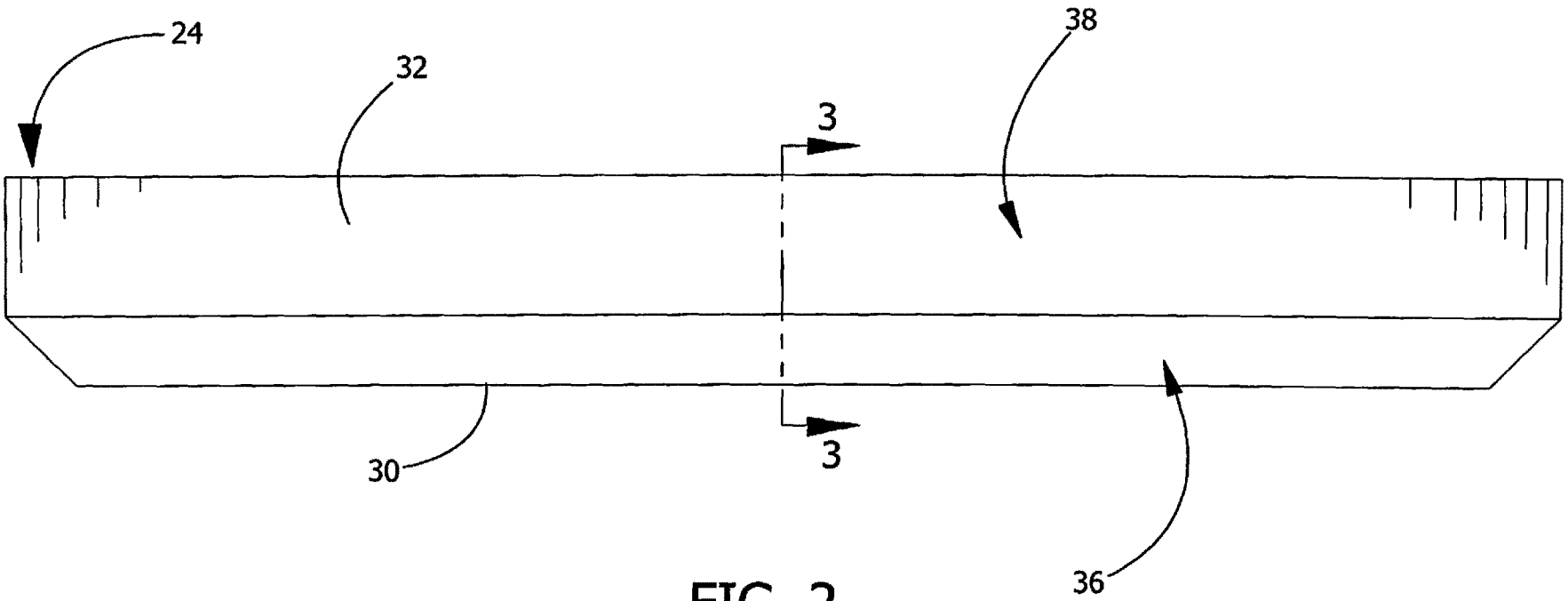
FIG. 2 is a front view of an annular channel of an embodiment of the disclosure.
Figure 3:
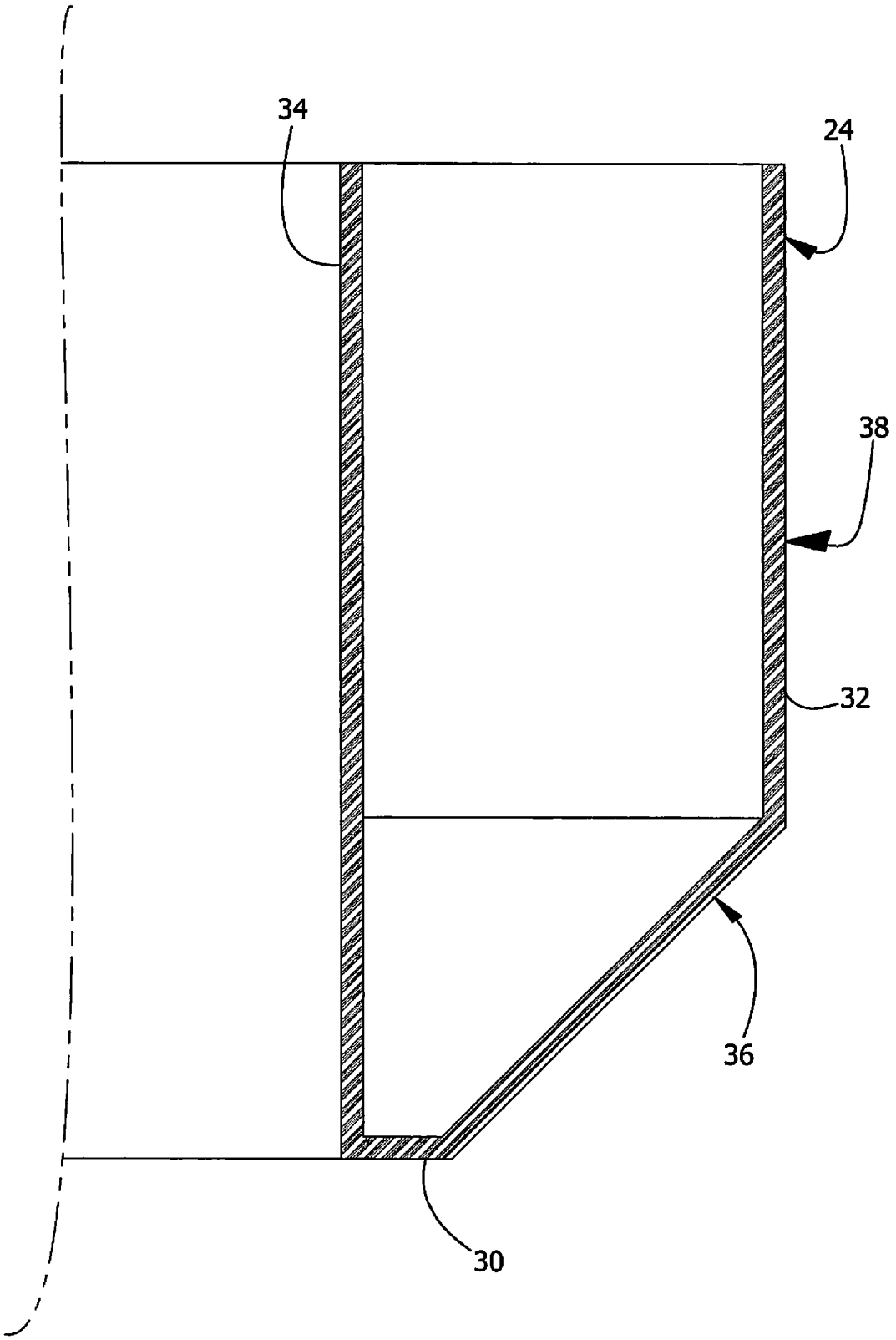
FIG. 3 is a cross sectional view taken along line 3-3 of FIG. 2 of an embodiment of the disclosure.
Figure 4:
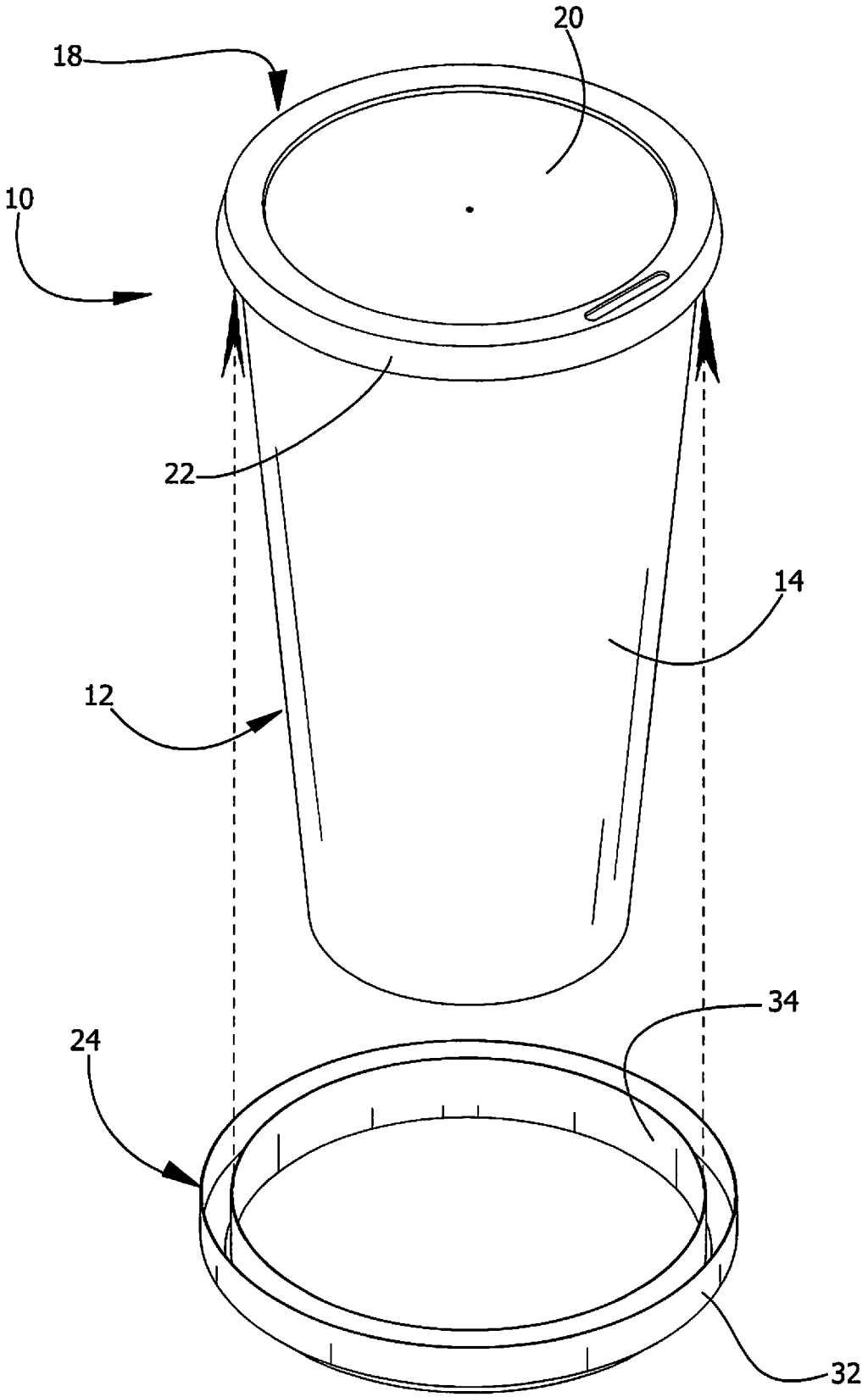
FIG. 4 is an exploded perspective view of a drip ring device according to an embodiment of the disclosure.
Figure 5:
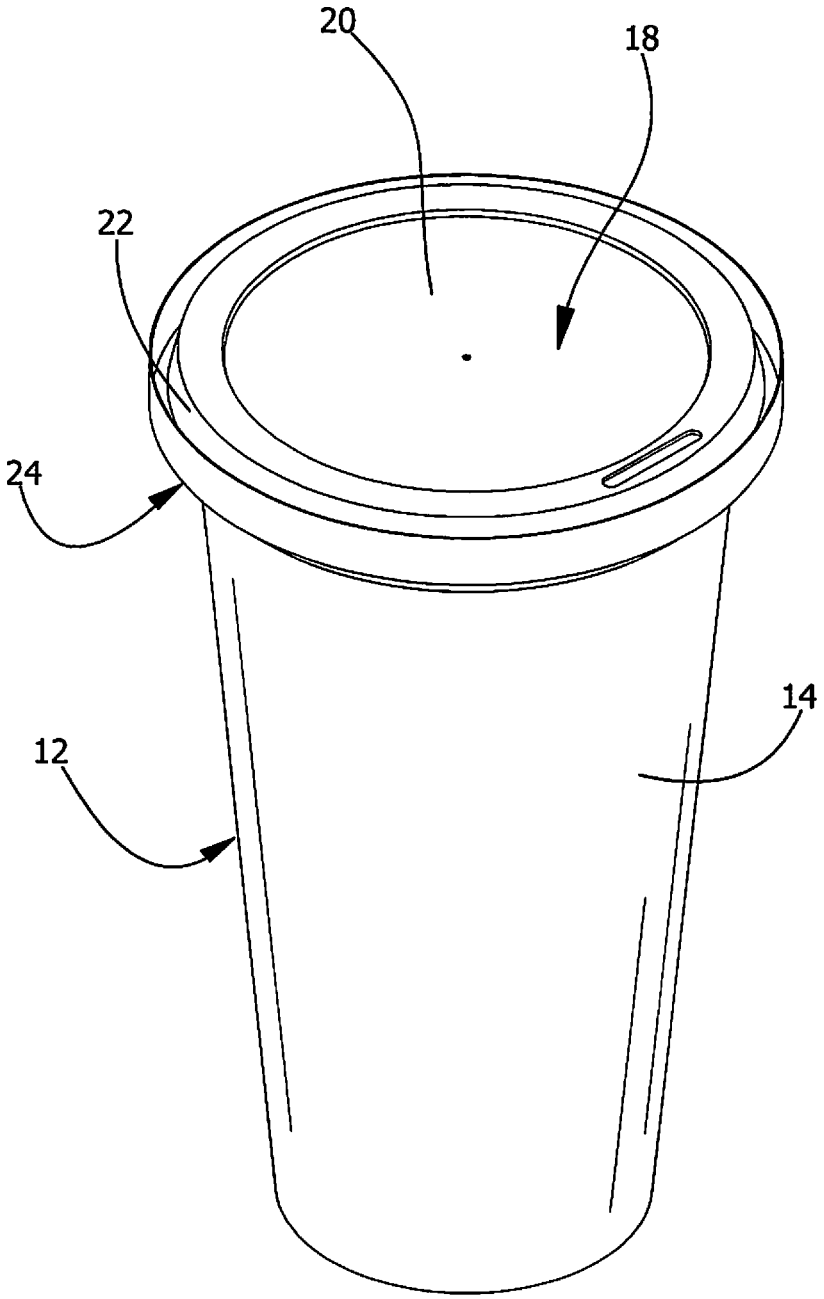
FIG. 5 is a perspective in-use view of an embodiment of the disclosure.
Figure 6:
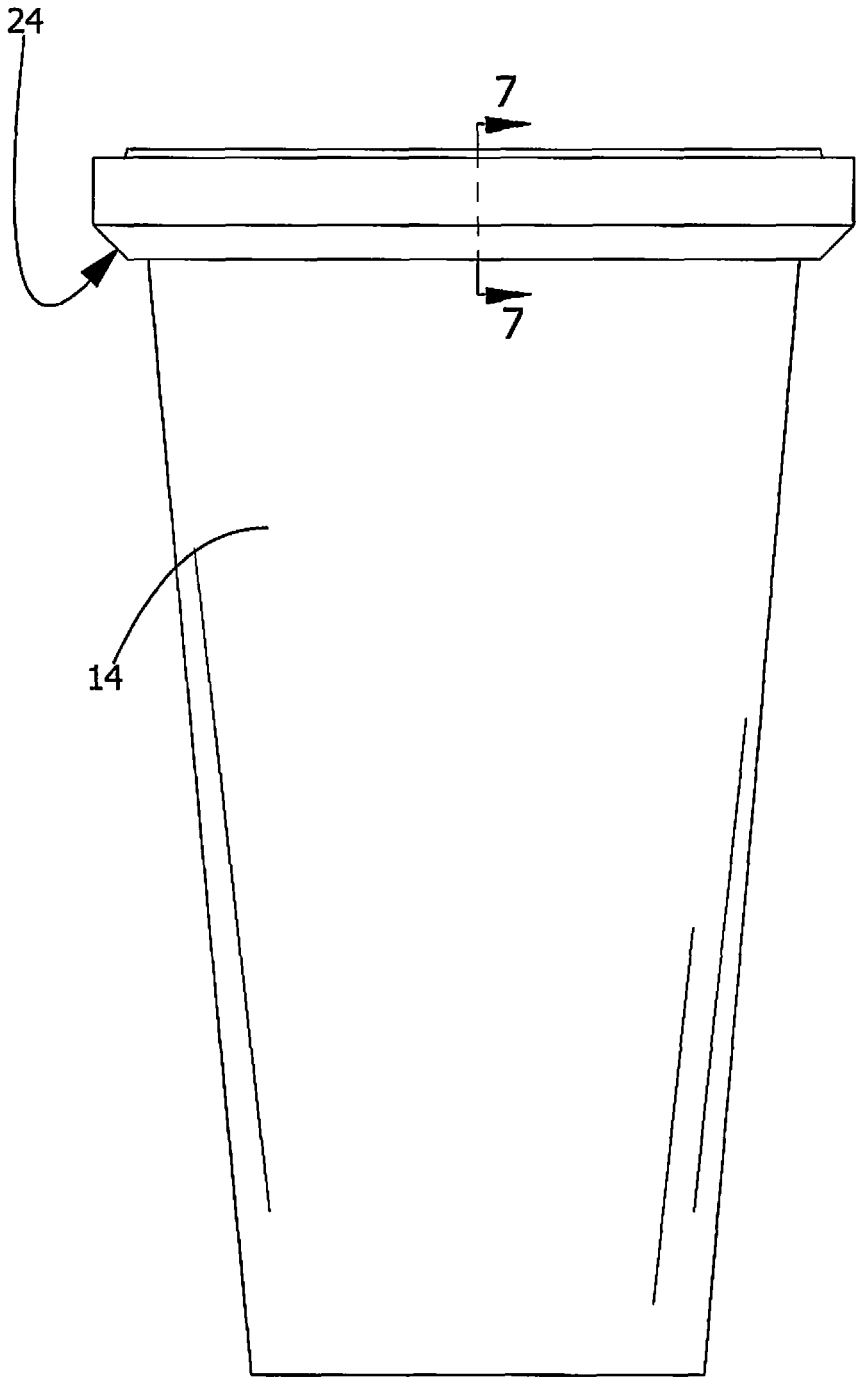
FIG. 6 is a front in-use view of an embodiment of the disclosure.
Figure 7:
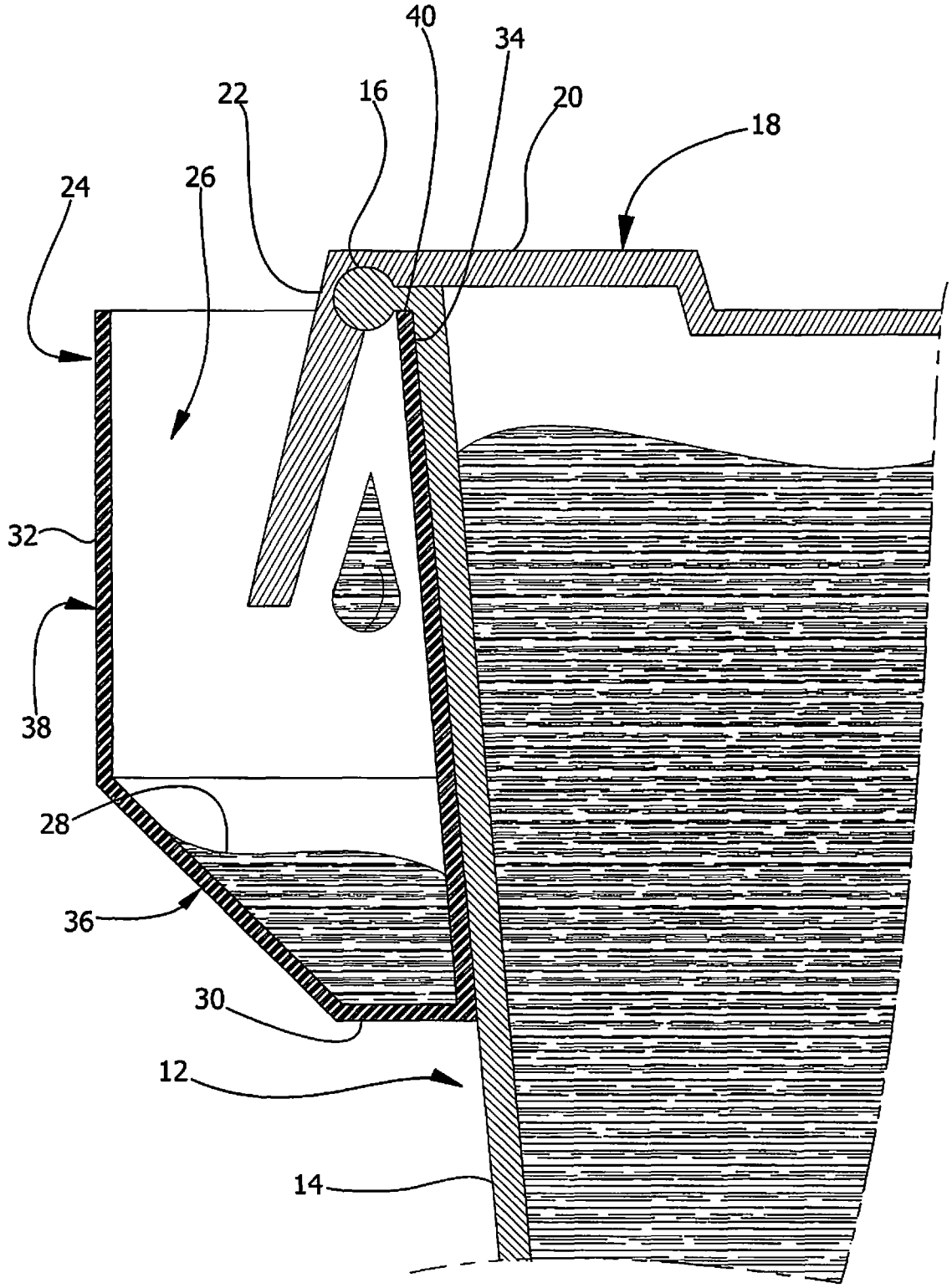
FIG. 7 is a cross sectional view taken along line 7-7 of FIG. 6 of an embodiment of the disclosure.

With reference now to the drawings, and in particular to FIGS. 1 through 8 thereof, a new drip device embodying the principles and concepts of an embodiment of the disclosure and generally designated by the reference numeral 10 will be described.

As best illustrated in FIGS. 1 through 8, the drip ring device 10 generally comprises a beverage cup 12 that has an exterior wall 14 and an upper edge 16. A lid 18 is attached to the beverage cup 12 such that the lid 18 closes the beverage cup 12 and the lid 18 has a top wall 20 and a perimeter wall 22 extending downwardly from the top wall 20. The perimeter wall 22 is spaced from and extends downwardly along the exterior wall 14 of the beverage cup 12 having the lid 18 releasably engaging the upper edge 16 of the beverage cup 12 for retaining the lid 18 on the beverage cup 12. The beverage cup 12 may be a disposable beverage cup commonly employed by coffee shops, fast food restaurants and other establishments the sell beverages to go.

An annular channel 24 is provided and the annular channel 24 is positionable around the beverage cup 12. The annular channel 24 is urgeable into a seated position having the annular channel 24 being positioned beneath the lid 18 when the lid 18 is attached to the beverage cup 12. In this way the annular channel 24 defines a drip space 26 beneath the lid 18 to capture liquid 28 that drips from the lid 18. Thus, the liquid 28 is inhibited from dipping on a user's clothing, for example, which can often result in unsightly stains.

The annular channel 24 has a basal wall 30 extending between an outer wall 32 and an inner wall 34. The outer wall 32 has an angled portion 36 angling upwardly from the basal wall 30 and a planar portion 38 extending upwardly from the angled portion 36. The planar portion 38 is spaced from and lies on a plane that is oriented parallel to the inner wall 34 such that the drip space 26 is defined between the inner wall 34 and the outer wall 32. Each of the inner wall 34 and the outer wall 32 is continuously arcuate about a center of the annular channel 24 such that inner wall 34 and the outer wall 32 define concentric rings.

Figure 8:
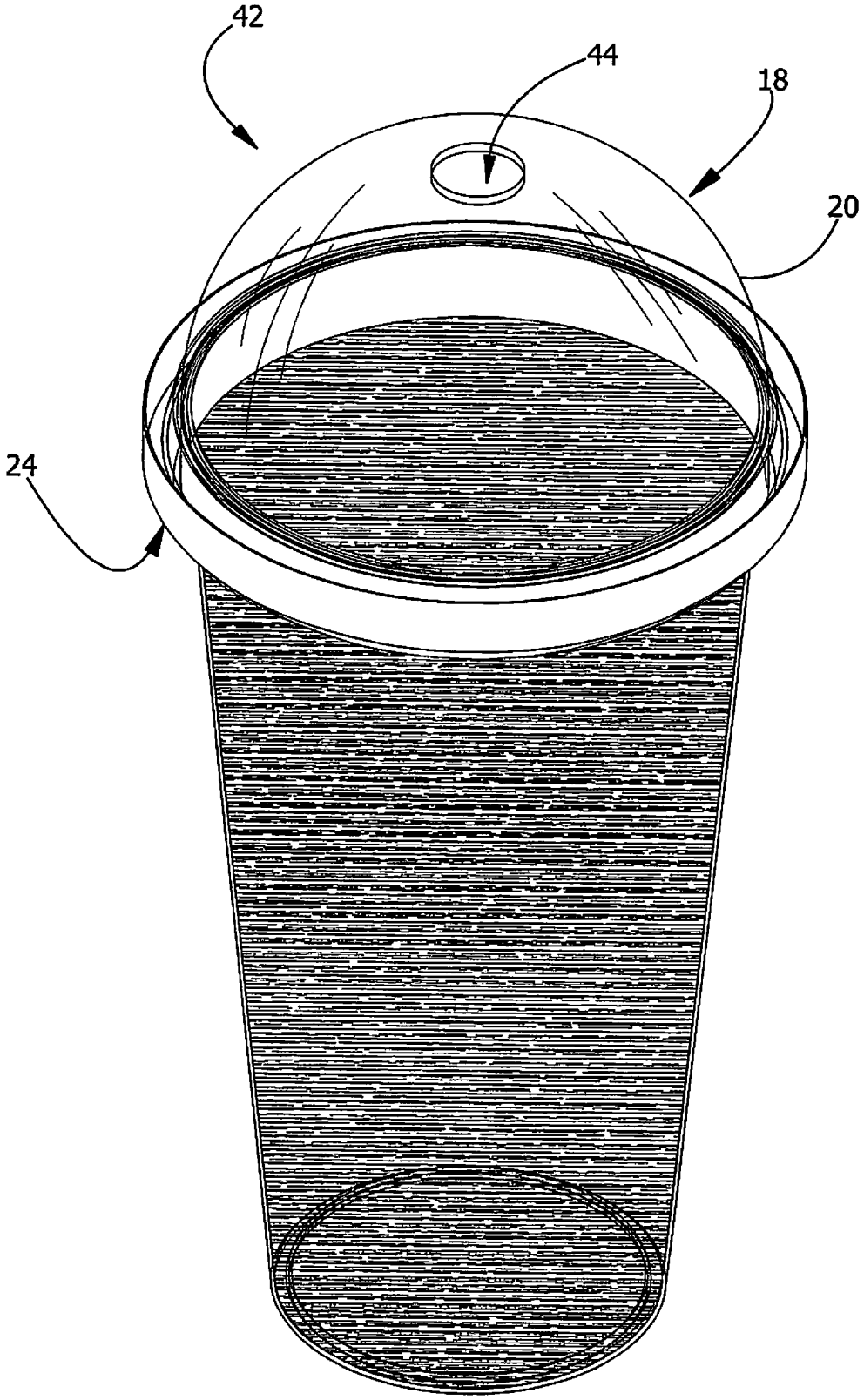
FIG. 8 is a perspective view of an alternative embodiment of the disclosure.

The inner wall 34 abuts the exterior wall 14 of the beverage cup 12 when the annular channel 24 is positioned around the beverage cup 12. A top edge 40 of the inner wall 34 abuts an intersection between the upper edge 16 of the beverage cup 12 and the lid 18 when the annular channel 24 is in the seated position. Additionally, the perimeter wall 22 of the lid 18 extends downwardly into the drip space 26. The annular channel 24 is comprised of a fluid impermeable material, including but not being limited to plastic or pressed paper, thereby facilitating the annular channel 24 to contain the liquid 28. Additionally, the annular channel 24 may have an interior diameter ranging between approximately 5.7 cm and 9.4 cm and an outside diameter ranging between approximately 6.9 cm and 10.6 cm and the drip space 26 may have a width of approximately 2.4 cm. In an alternative embodiment 42 as is shown in FIG. 8, the top wall 20 of the lid 18 may be concavely arcuate such that the lid 18 defines a dome shape and the lid 18 may have a straw aperture 44 that is centrally located on the top wall 20 of the lid 18.

In use, the annular channel 24 is slid 18 around the beverage cup 12 until the top edge 40 of inner wall 34 of the annular channel 24 abuts the intersection between the upper edge 16 of the outer wall 32 of the beverage cup 12 and the lid 18. In this way the perimeter wall 22 of the lid 18 extends downwardly into the drip space 26 defined by the annular channel 24. Thus, the drip space 26 captures liquid 28 that drips from the lid 18 when the liquid 28 passes between the upper edge 16 of the outer wall 32 of the beverage cup 12 and the lid 18. In this the annular channel 24 inhibits the liquid 28 from dripping on a user's clothing and potentially staining the user's clothing.

With respect to the above description then, it is to be realized that the optimum dimensional relationships for the parts of an embodiment enabled by the disclosure, to include variations in size, materials, shape, form, function and manner of operation, device and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A drip ring device for capturing fluid that drips from a lid of a beverage cup, said device comprising:

a beverage cup;

a lid being attached to said beverage cup such that said lid closes said beverage cup; and an annular channel being positionable around said beverage cup, said annular channel being urgeable into a seated position having said annular channel being positioned beneath said lid when said lid is attached to said beverage cup such that said annular channel defines a drip space beneath said lid wherein said drip space is configured to capture liquid that drips from said lid, wherein:

said annular channel has a basal wall extending between an outer wall and an inner wall;

said outer wall has an angled portion angling upwardly from said basal wall and a planar portion extending upwardly from said angled portion;

said planar portion is spaced from and lying on a plane being oriented parallel to said inner wall such that said drip space is defined between said inner wall and said outer wall; and each of said inner wall and said outer wall is continuously arcuate about a center of said annular channel such that inner wall and said outer wall define concentric rings.

2. The device according to claim 1, wherein:

said beverage cup has an exterior wall and an upper edge;

said annular channel has a basal wall extending between an outer wall and an inner wall; and said inner wall abuts said exterior wall of said beverage cup when said annular channel is positioned around said beverage cup.

3. The device according to claim 2, wherein:

said lid has a top wall and a perimeter wall extending downwardly from said top wall;

said perimeter wall is spaced from and extends downwardly along said exterior wall of said beverage cup having said lid releasably engaging said upper edge of said beverage cup for retaining said lid on said beverage cup; and a top edge of said inner wall of said annular channel abuts an intersection between said upper edge of said beverage cup and said lid when said annular channel is in said seated position having said perimeter wall of said lid extending downwardly into said drip space.

4. A drip ring device for capturing fluid that drips from a lid of a beverage cup, said device comprising:

a beverage cup having an exterior wall and an upper edge;

a lid being attached to said beverage cup such that said lid closes said beverage cup, said lid having a top wall and a perimeter wall extending downwardly from said top wall, said perimeter wall being spaced from and extending downwardly along said exterior wall of said beverage cup having said lid releasably engaging said upper edge of said beverage cup for retaining said lid on said beverage cup; and an annular channel being positionable around said beverage cup, said annular channel being urgeable into a seated position having said annular channel being positioned beneath said lid when said lid is attached to said beverage cup such that said annular channel defines a drip space beneath said lid wherein said drip space is configured to capture liquid that drips from said lid, said annular channel having a basal wall extending between an outer wall and an inner wall, said outer wall having an angled portion angling upwardly from said basal wall and a planar portion extending upwardly from said angled portion, said planar portion being spaced from and lying on a plane being oriented parallel to said inner wall such that said drip space is defined between said inner wall and said outer wall, each of said inner wall and said outer wall being continuously arcuate about a center of said annular channel such that inner wall and said outer wall define concentric rings, said inner wall abutting said exterior wall of said beverage cup when said annular channel is positioned around said beverage cup, a top edge of said inner wall abutting an intersection between said upper edge of said beverage cup and said lid when said annular channel is in said seated position having said perimeter wall of said lid extending downwardly into said drip space.

* * * * *